US006000188A

United States Patent [19]

Cazzolaro

[11] Patent Number: 6,000,188

[45] Date of Patent: Dec. 14, 1999

[54] ASSEMBLY OF BOARD FOR FLOOR BOARDING AND MEANS FOR FIXING THE SAME TO ADJACENT BOARDS

[76] Inventor: Sergio Cazzolaro, Loc. Villa Rotta—Casa Ivana, Castiglione D'Adda (MI), Italy, 20072

[21] Appl. No.: 09/001,290

[22] Filed: Dec. 31, 1997

[30] Foreign Application Priority Data

Dec. 31, 1996 [IT] Italy ..... MI96A2763

[51] Int. Cl.[6] ..... E04H 12/18; E04C 2/38

[52] U.S. Cl. ..... 52/645; 52/656.9; 52/656.1; 52/578; 403/310; 403/313

[58] Field of Search ..... 52/480, 578, 584.1, 52/650.3, 656.1, 690, 271; 403/300, 310, 311, 312, 329, 326

[56] References Cited

U.S. PATENT DOCUMENTS 5,469,678 11/1995 Zamerovsky ..... 52/650.3

5,625,987 5/1997 Zamerovsky ..... 52/650.1

*Primary Examiner*—Carl D. Friedman

*Assistant Examiner*—Dennis L. Dorsey

*Attorney, Agent, or Firm*—Millen, White, Zelano, & Branigan, P.C.

[57] ABSTRACT

There is disclosed an assembly of board for floor boarding and means for fixing the same to adjacent boards, said board comprising a frame, of generally rectangular shape, suitable for accommodating therein a flooring surface, such frame comprising a first pair of opposite beams and a second pair of opposite beams connecting the first pair of beams. The beams of said first pair are provided, at least at their ends, with recesses suitable for housing clamps for coupling the board with adjacent boards. The recesses are associated to releasable snap engagement means that engage in respective seats provided for on the clamps to prevent the clamps from slipping out of said recesses.

12 Claims, 5 Drawing Sheets

ASSEMBLY OF BOARD FOR FLOOR BOARDING AND MEANS FOR FIXING THE SAME TO ADJACENT BOARDS

The present invention deals with an assembly of board for floor boarding and means for fixing the same to adjacent boards.

It is known that a flooring surface (stage, planking, buoyant pavement etc.) is composed of vertical posts, generally of iron, joints connecting the posts to each other so as to confer rigidity to the structure, and a rigid surface laid on and/or fixed to the structure that forms the real flooring surface, also called "technical boarding".

Said floor boarding consists of a plurality of boards, that can be made of a metal frame superficially coated with wood, aluminium, tiles or other suitable material.

Said boards are close to each other, and can simply be laid on or fixed to the bearing structure.

In view of the state of the art described above, object of the present invention is to provide for a board assembly for floor boarding of the type simply laid on a bearing structure, and respective means for fixing the board to adjacent boards that allows to obtain a continuous and steady flooring platform, and that allows also to speed the assemblage and disassemblage operations.

According to the present invention, such object is attained by means of an assembly of board for floor boarding and means for fixing the same to adjacent boards, said board comprising a usually rectangular frame suitable for accommodating therein a flooring surface, such frame comprising a first pair of opposite beams and a second pair of opposite beams connecting the first pair of beams, characterised in that the beams of said first pair are provided, at least at their ends, with recesses suitable for housing clamps for coupling the board with adjacent boards, said recesses being associated to releasable snap engagement means that engage in respective seats provided for on said clamps to prevent the clamps from slipping from said recesses.

Thanks to the present invention, it is possible to build a stage, a planking, a buoyant pavement etc. in which the boards forming the flooring surface are fixed to each other in such a way so as to result solid, thus forming a single continuous steady platform.

The boards assemblage operations to form the boarding are substantially simplified, and the disassemblage of the boards is also rapid and easy.

Preferably, said clamps are of three types: one to allow the connection of inside boards and two for the connection of the perimetric ones.

These and other characteristics and advantages of the present invention will be rendered more evident by the following detailed description of some embodiments, illustrated as a non-restrictive example in the enclosed drawings, where:

Figure 1:
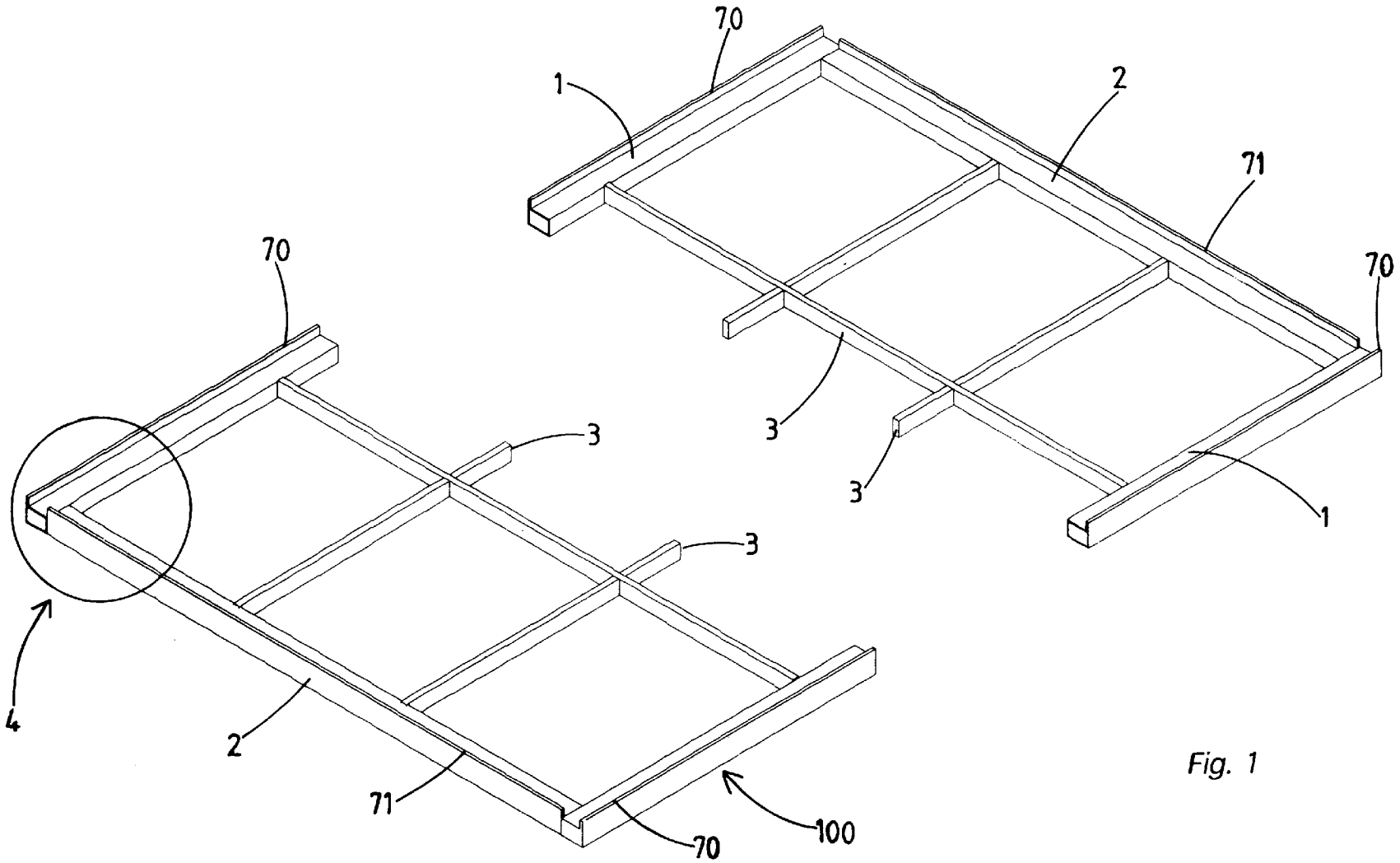
FIG. 1 is a perspective view of a boarding frame according to the invention.
Figure 3:
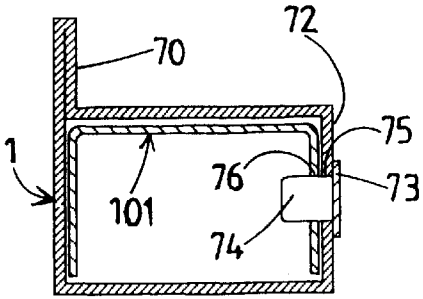
FIG. 3 is a section according to a plane orthogonal to the frame, passing through the line III—III of FIG. 2.

With reference to FIG. 1, there is shown a perspective of a frame 100 of a board for floor boarding according to the invention; the frame has a generally rectangular shape, and comprises a first pair of internally hollow opposite beams (whose section can be seen in FIG. 3), a second pair of beams 2 connecting the first pair of beams at their ends, and a plurality of beams 3 acting as a support to a pavement element or flooring surface (not shown) that is inserted over them. Thanks to the shape of the frame 100, in particular to the fact that beams 1 and 2 are provided with respective longitudinal edges 70, 71, the pavement is inserted inside the frame without the possibility of a translatory movement.

Figure 2:
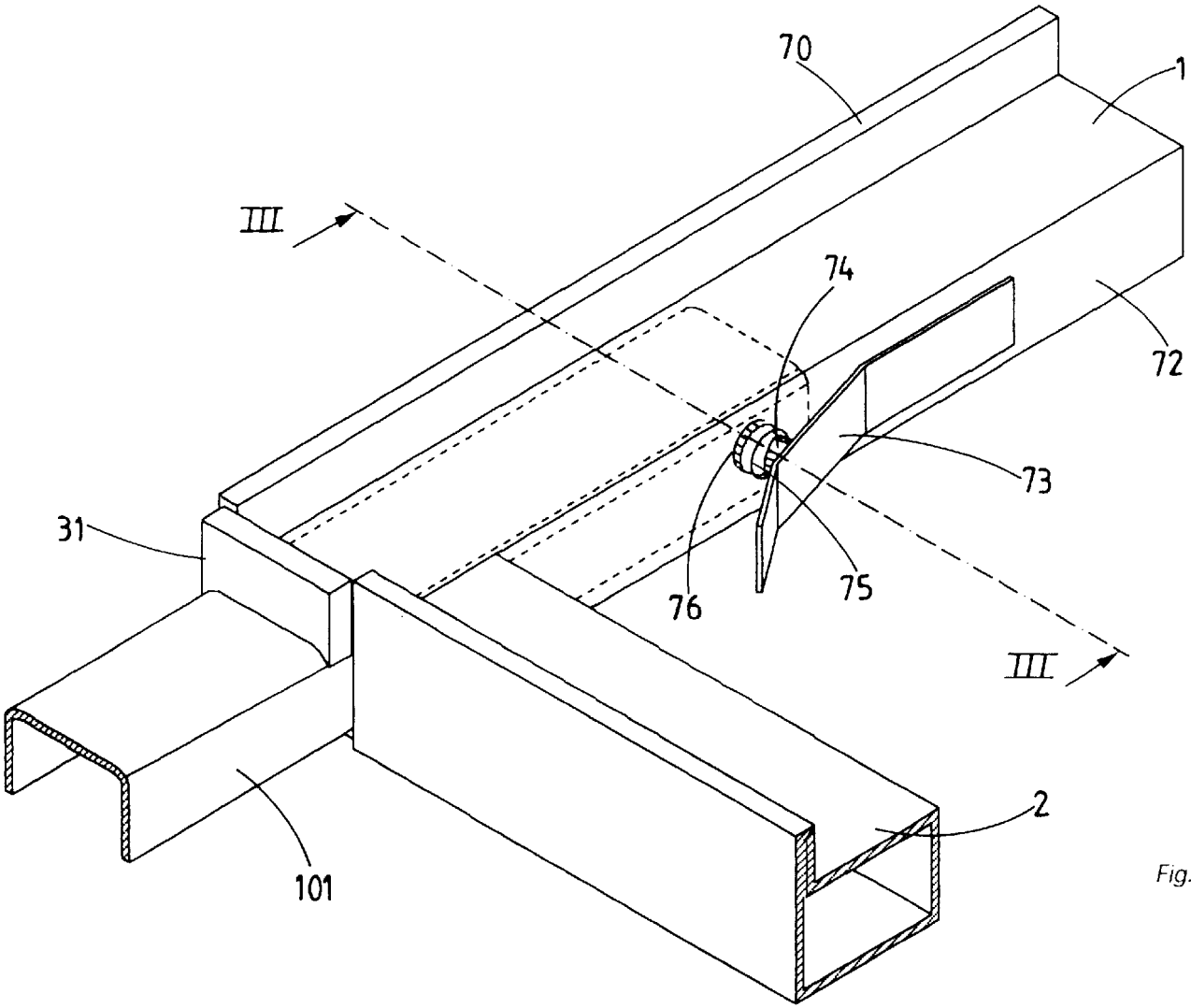
FIG. 2 is an enlarged perspective view of a corner of the frame of FIG. 1, in which a clamp for connection with the adjacent boards is inserted.

FIG. 2 shows in detail the corner zone 4 of the frame of FIG. 1. Inside the beam 1, that as mentioned is internally hollow, a clamp 101 is inserted for coupling the board to an adjacent board. As it will be explained later, the clamp 101 is one of three different clamps, and it is used for coupling the peripheral boards of a stage. To the vertical inside wall 72 of the beam 1, near its end, there is applied, for example by means of rivets or weld beads, an elastic plate 73, preferably metallic, to the inside wall of which a pawl 74 is applied. In correspondence of the pawl 74, in the inside wall 72 of the beam 1 a through hole 75 is drilled suitable to accommodate the same pawl 74. The elastic plate 73 stresses the pawl to penetrate into the hole 75 (for clearness in FIG. 2 the elastic plate is not shown in rest position). The clamp 101 is also provided, in its vertical wall, with a through hole 76 serving the purpose to receive the pawl 74 (FIG. 3): in this way, the clamp 101 cannot be slid out of the beam 1 unless acting on the elastic plate 73 in such a way as to bring the pawl 74 out of the hole 76.

Figure 4:
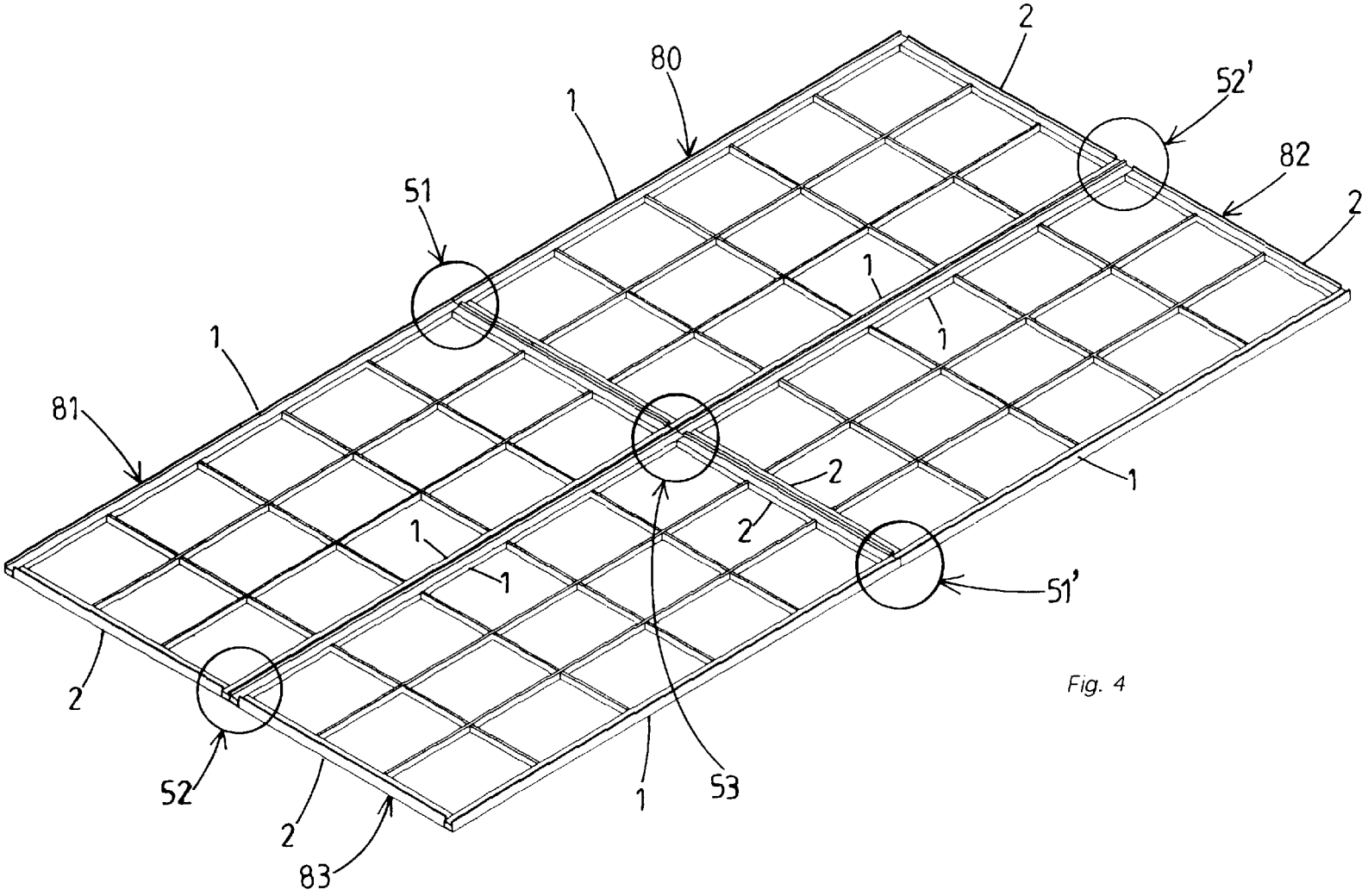
FIG. 4 shows a perspective of a group of boards coupled so as to form the floor boarding.
Figure 7:
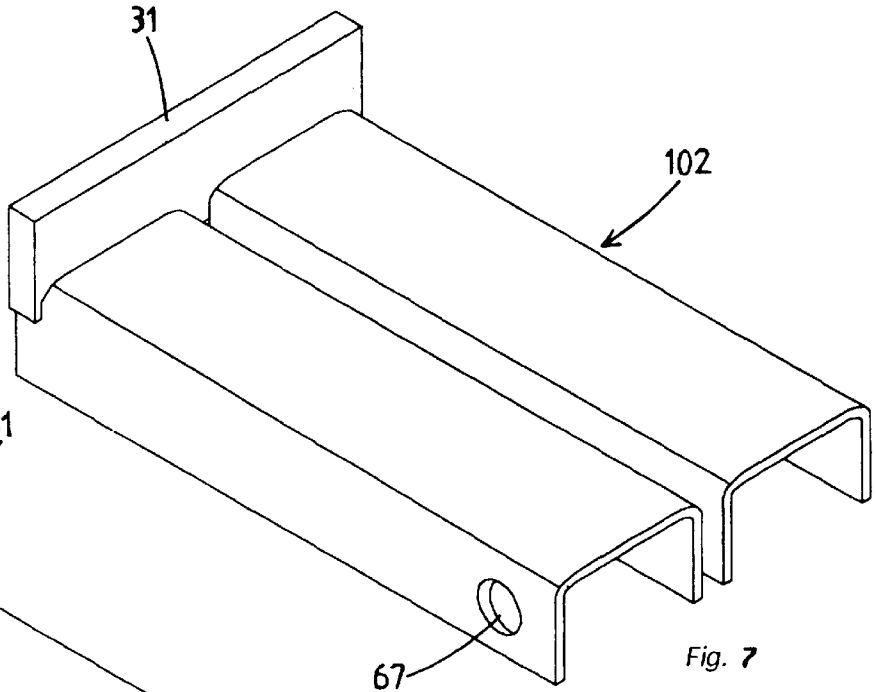
FIG. 7 shows a perspective of a second form of connecting clamp for connection of peripheral boards of the floor boarding.

FIG. 4 shows a group of four frames 80–83 of the type shown in FIG. 1 laid near so as to form a stage boarding. In the figure coupling zones of the frames 51, 51', 52, 52' and 53 are marked out: these three zones correspond to three different types of connection clamps, that will be described now.

Figure 5:
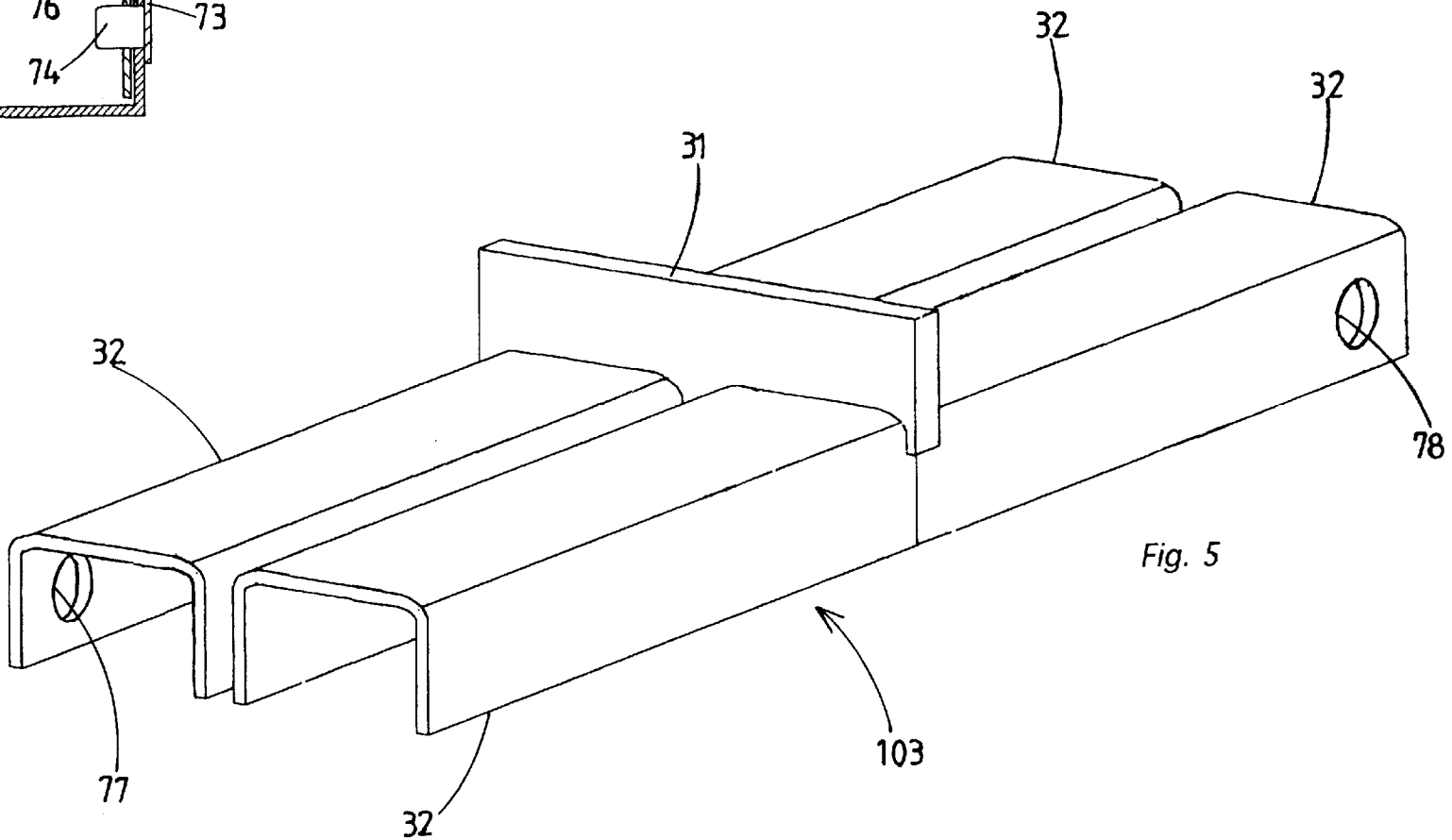
FIG. 5 shows a perspective of a connecting clamp for the connection of inside boards of the floor boarding.

For the coupling of frames 80–83 in the zone 53 in which the four frames have a common vertex, the clamp 103 shown in FIG. 5 is used; such clamp is made substantially of two beams 32 with a "U" section joined by means of a projecting cross beam 31, which divides them into two parts substantially with equal length that we will refer to as arms. In diagonally opposite positions two through holes 77, 78 are made that are suitable to receive, when the clamps arms are inserted into the beams I of the frames 80–83, the pawls provided at the end of the frames 81 and 82; in this way the frames 81 and 82 cannot be taken apart of each other in the direction of their beams 1; in addition the frames 80 and 81 cannot be taken apart in the direction of their beams 2.

Figure 6:
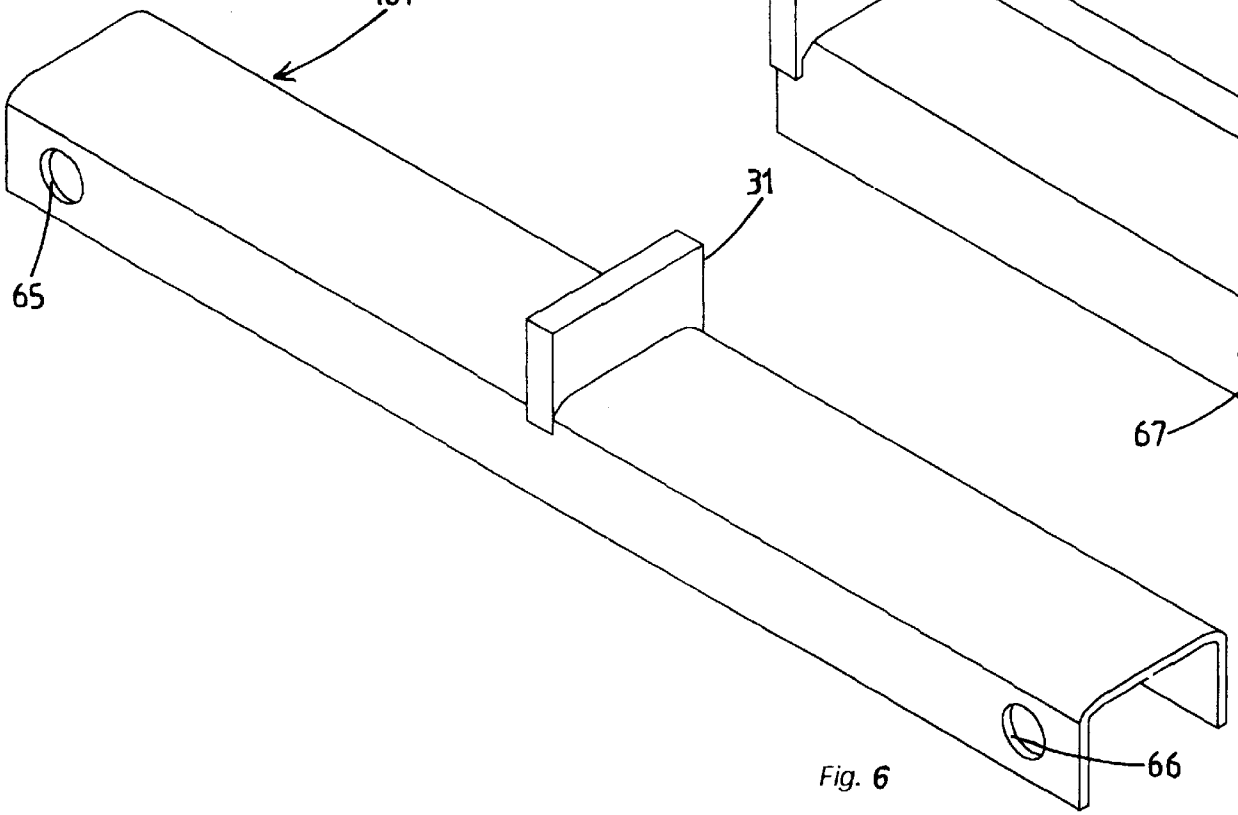
FIG. 6 shows a perspective of a first form of connecting clamp for the connection of peripheral boards of the floor boarding.

For the coupling of frames 80 and 81 in the zone 51 the clamp 101 shown in FIG. 6 is used. Said clamp 101 is substantially obtained from the clamp 103 by eliminating one of the two "U" beams, reappraising the length of the beam 31 and drilling a new hole on the same side of the previous one. The clamp therefore shows two holes 65 , 66 suitable to accommodate, when the clamp arms are inserted into the beam 1 of the frames 80 and 81, the respective pawls 74 provided at the ends of the frames 80 and 81; in this way the frame 80 is solidly connected with the frames 81 and 82.

In an analogous way, in order to couple the frames 82 and 83 in the zone 51' another clamp 101 is used; in this way the frame 83 is also solidly connected with the others.

Finally, in the zones 52 and 52' the clamp 102 is inserted. Said clamp is substantially obtained by clamp 103 of FIG.

5 by eliminating the two fore or back arms of the same. Said clamp is therefore provided with a hole 67 suitable to receive the pawl 74 found at the end of the frame 83 (zone 52) and the pawl 74 found at the end of the frame 80 (zone 52'); in this way the frames 81 and 83, even if they are not subject to different loads, lay on the same plane (that is the clamp 102 prevents the boards to off-centre). In addition, the clamp 102 can be utilised for fixing (to the beam 31) a possible railing.

By means of such connections, each board is rigidly connected to the adjacent ones thus eliminating the possibility of any roto-translatory movement.

It is pointed out that the shape and the materials which the clamps are made of are not subject to limitations: the clamps 101, 102 and 103 can be of any shape and can be made of any suitable material.

I claim:

1. Assembly of board for floor boarding and means for fixing the same to adjacent assemblies of board, said assembly comprising a frame substantially rectangular in shape suitable for accommodating therein a flooring surface, said frame comprising a first pair of opposite beams and a second pair of opposite beams connecting the first pair of beams; said first pair of beams having open ends comprising walls forming a recess; said means for fixing comprising releasable snap engagement means attached near said open ends; one or more clamps, wherein each of said one or more clamps has at least two seats; and wherein said one or more clamps are slidably insertable into said recess and said releasable snap engagement means engages with one of said at least two seats of said one or more clamps to prevent said one or more clamps from slipping from said recess; whereby said clamps are utilized to connect said assembly or board to one or more adjacent assembly of board.

2. The assembly and the means for fixing according to claim 1, wherein said releasable snap engagement means comprise: an elastic plate coupled to one of said walls of said first pair of beam, a pawl applied to said elastic plate; and wherein said walls of said first pair of beams comprising a hole suitable to accommodate said pawl, said pawl being stressed by said elastic plate so as to penetrate in to the recess of the beam through said hole.

3. The assembly according to claim 2, wherein said walls comprising an outside wall, an inside wall, a top wall, and a bottom wall; and wherein said elastic plate is applied to said inside wall of said first pair of opposite beams.

4. The assembly of claim 1, wherein said clamps are formed by two aligned beam portions with a transversal projecting crossbeam at their connecting section.

5. The assembly of claim 1, wherein said clamps are formed by two parallel beams portions which are connected to each other at one end by a transversal projecting crossbeam.

6. The assembly of claim 1, wherein said clamps are formed by a pair of identical parallel beams connected by a transversal projecting crossbeam at the center of said parallel beams.

7. An assembly for floor boarding comprising:

a board and fixing means for fixing said board to adjacent boards;

said board comprising a substantially rectangular frame for accommodating a flooring surface;

said frame comprising a first pair of parallel tubular beams and a second pair of parallel tubular beams perpendicular to said first pair;

said tubular beams having open ends;

said fixing means comprising elongated clamps slidingly insertable in said open ends of said tubular beams of said board and said adjacent boards; and snap engagement means for releasably locking said clamps and said tubular beams.

8. The assembly of claim 7, wherein said tubular beams comprising walls, one of which having a hole; said clamps comprising one or more seats; and wherein said releasable snap locking means comprises an elastic plate fastened to one of said walls of said tubular beam near said open end thereof, and a pawl connected to said elastic plate and elastically urged into one of said seats of one of said clamps through said hole on one of said walls of one of said tubular beam.

9. The assembly of claim 8, wherein said one wall of said tubular beam is a wall faced towards the inside of said frame.

10. The assembly of claim 7, wherein said clamps are formed by two aligned beam portions with a transversal projecting crossbeam at their connecting section.

11. The assembly of claim 7, wherein said clamps are formed by two parallel beams portions which are connected to each other at one end by a transversal projecting crossbeam.

12. The assembly of claim 7, wherein said clamps are formed by a pair of identical parallel beams connected by a transversal projecting crossbeam at the center of said parallel beams.

* * * * *